United States Patent [19]

Lecinski, Jr. et al.

[11] Patent Number: 4,562,930

[45] Date of Patent: Jan. 7, 1986

[54] CONTAINER FINISH FOR RESEALING WITH PT CLOSURE

[75] Inventors: Frank H. Lecinski, Jr., Harwood Heights; Chester F. Grzemski, Darien, both of Ill.

[73] Assignee: Continental White Cap, Inc., Northbrook, Ill.

[21] Appl. No.: 589,259

[22] Filed: Mar. 13, 1984

[51] Int. Cl.[4] ..... B65D 23/00

[52] U.S. Cl. ..... 215/31; 215/318; 215/341

[58] Field of Search ..... 215/31, 317, 318, 321, 215/329, 341, 353

[56] References Cited

U.S. PATENT DOCUMENTS

| | | | |
|---|---|---|---|
| 1,499,612 | 7/1924 | Hammer | 215/331 X |
| 1,676,023 | 7/1928 | Hammer . | |
| 1,849,522 | 3/1932 | Hammer . | |
| 2,265,015 | 12/1941 | Watson . | |
| 2,298,777 | 10/1942 | Thomas | 215/330 X |
| 2,670,868 | 3/1954 | Stover et al. | 215/31 |
| 2,952,374 | 9/1960 | Pryale | 215/40 |
| 3,182,843 | 5/1965 | Foye | 215/44 |
| 3,270,904 | 9/1966 | Foster et al. | 215/43 |
| 3,285,452 | 11/1966 | Moloney et al. | 215/40 |
| 3,448,881 | 6/1969 | Zipper | 215/40 |
| 3,473,684 | 10/1969 | Wagner | 215/40 |
| 3,532,243 | 10/1970 | Hart et al. | 215/40 |
| 3,559,833 | 2/1971 | Alonso | 215/31 |
| 3,690,497 | 9/1972 | Lecinski, Jr. | 215/318 |
| 4,000,825 | 1/1977 | Westfall | 215/318 |
| 4,383,620 | 5/1983 | Mumford | 215/341 X |
| 4,444,325 | 4/1984 | Lecinski, Jr. | 215/31 |

FOREIGN PATENT DOCUMENTS

| | | | |
|---|---|---|---|
| 2453963 | 12/1975 | Fed. Rep. of Germany | 215/318 |

*Primary Examiner*—Steven M. Pollard

*Attorney, Agent, or Firm*—Charles E. Brown

[57] ABSTRACT

This relates to glass container neck finishes which are particularly configurated for use solely with PT closures which are provided with liners formed of a suitable compound and wherein the closures are pressed onto the container neck finishes and removed therefrom by a twisting action. The neck finishes are particularly configurated to facilitate the re-engagement of the closures with the neck finishes by twisting actions so as to assure both the interlocking of the closures with the neck finishes and the resealing of the containers.

11 Claims, 13 Drawing Figures

CONTAINER FINISH FOR RESEALING WITH PT CLOSURE

This invention relates in general to new and useful improvements in glass containers of the jar and bottle type, and more particularly to neck finishes suitable for resealing wherein the neck finishes are particularly configurated to function with well known PT closures, i.e. press-on-twist-off closures.

Conventional PT closures include a shell having therein a liner which is conventionally formed of a plastisol and wherein such lining includes an annular portion which is carried by an end panel of the closure and abuts in sealing engagement with an end of the neck finish in a generally cylindrical portion which lines the skirt of the closure. The closure, in use, is pressed onto the neck finish and the cylindrical liner portion flows around plural lead threads of the neck finish tightly to hold the closure on the glass container in sealing relation. When the closure is to be opened, the closure is rotated or twisted with the threads leading the closure off of the container.

Resealing a PT cap has always presented difficulties and is the major objection to the use of such a cap or closure. The typical fine lead glass finishes have made it difficult for one to hand reapply the closure using a twist-the-closure-on approach. The thread impressions formed in the sealing compound (plastisol) do not easily find their way onto the threads of the glass neck finish, and in the process of trying to reclose the cap one side of the cap will engage the threads and the other will not. In this incorrect start of reapplication, and if the product is one that requires shaking before use, the cap will generally fly off and product spillage will be encountered.

Also, a poorly reapplied closure poses the threat of the bottle and its contents falling away if the container is lifted by grasping only the closure.

In accordance with this invention, there is provided a modified neck finish for a glass container which is specifically configurated to be closed by a PT closure. It is to be understood that the invention is solely related to neck finishes having multi-lead threads which threads are initially utilized only to facilitate the removal of the closure and wherein the threads mold threads into a cylindrical liner portion of a PT closure after the closure has been pressed on the container. In other words, the neck finishes provided in accordance with this invention are not intended to be used in combination with closures wherein the skirts of the closures have metal or plastic parts which are either initially threaded for twist-on application or which are rolled onto the neck finish.

The improved neck finishes include such features as threads which increase in width from their lead-ins, neck finishes which are stepped or tapered above the threads, threads which have their outer surfaces in a conical arrangement, threads which are of a generally flattened rectangular cross section, threads which have generally double starting leads, and threads which have flattened outermost central surfaces.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
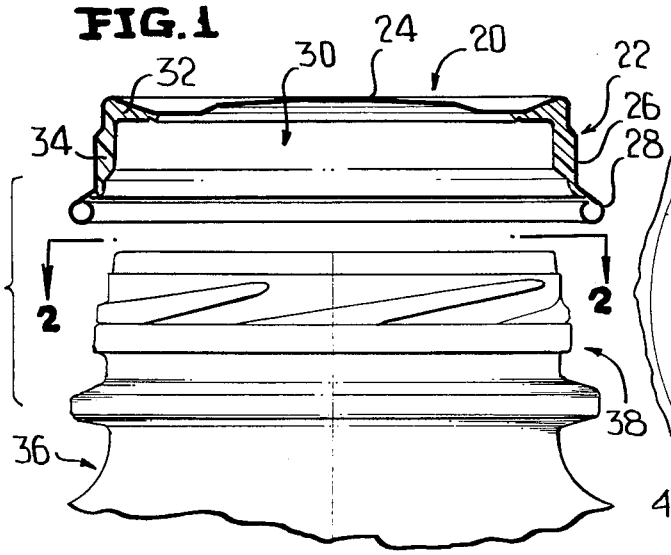
FIG. 1 is an exploded fragmentary elevational view of the upper portion of a glass container having a neck finish in accordance with this invention and having illustrated in cross section a conventional PT closure to be secured thereto.
Figure 2:
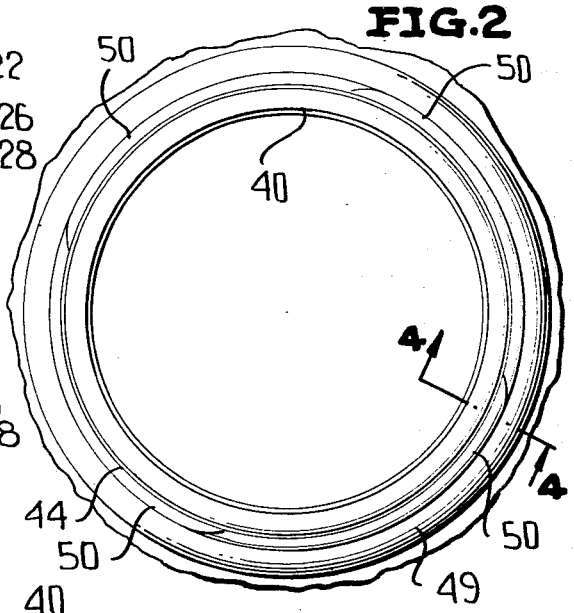
FIG. 2 is a plan view of the neck finish of the container of FIG. 1, taken generally along the line 2—2 of FIG. 1.

Referring now to the drawings in detail, reference is first made to FIG. 1 wherein there is illustrated a conventional PT closure generally identified by the numeral 20. The closure 20 includes a metal shell 22 which includes an end panel 24 and a skirt 26, with the skirt terminating in a curl 28. The shell 22, in the illustrated embodiment, is formed of metal and is provided with a liner generally identified by the numeral 30 formed of a suitable deformable compound such as plastisol. The liner 30 includes an upper annular section 32 which seats against the underside of an outer part of the end panel 24. The liner 30 also includes a generally cylindrical part 34 which is applied interiorly of the skirt 26.

As previously described, this conventional PT closure will be pressed onto the glass neck finish of a glass container and threads of the neck finish will mold complementary threads into the cylindrical liner portion 34 to facilitate removal of the closure from the neck finish by a twisting action.

In FIGS. 1–5 there is illustrated a glass container generally identified by the numeral 36 and having a neck finish in accordance with this invention, the neck finish being identified by the numeral 38 and being thickly configurated to facilitate the resealing of the container 36 by the closure 20.

Figure 3:
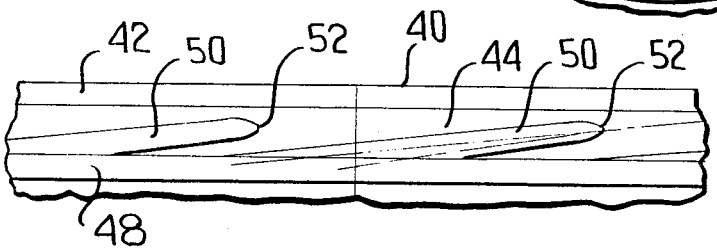
FIG. 3 is a developed view of the neck finish.
Figure 4:
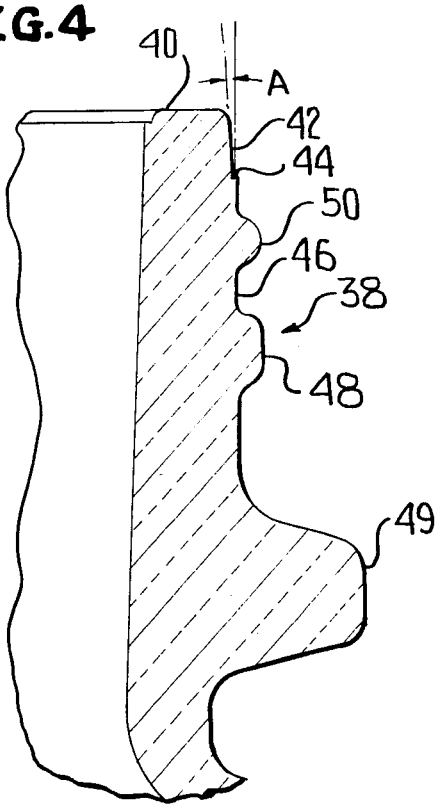
FIG. 4 is an enlarged fragmentary sectional view taken generally along the line 4—4 of FIG. 2, and shows the specific cross section of the neck finish.

As is best shown in FIG. 4, the neck finish 38 has an extreme end 40 for engaging the liner part 32 and forming a seal with the closure 20. The neck finish 38, immediately below the end 40, is stepped radially inwardly and is tapered in an upwardly axial and radially inward direction to define a tapered endmost portion 42 of the neck finish 38. Below the resultant step 44, the neck finish is of a constant diameter to define a thread base 46. The thread base 46 terminates in an annular rib 48. If desired, there may be a bead such as the bead 49 spaced axially below and projecting radially outwardly to a greater extent than the rib. The thread base 46 has projecting radially outwardly therefrom a plurality of threads 50, each having its own separate lead-in 52. It is to be noted from FIG. 3 that each of the plural threads 50 terminates in the rib 48 and it will be apparent from FIG. 2 that there is a plurality of such threads 50 which are spaced circumferentially about the neck finish. These threads preferably overlap one another as shown in FIG. 3.

A particular feature of each thread 50 is that in addition to having a generally rounded lead-in 52, each thread tapers in width from its lead-in to its base connection with the rib 48.

Figure 5:
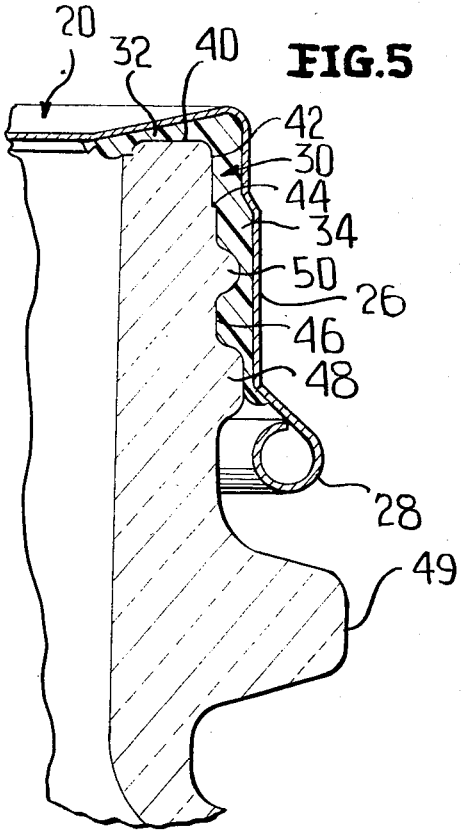
FIG. 5 is a fragmentary sectional view similar to FIG. 4, with a PT closure or cap applied.

Referring now to FIG. 5, it will be seen that although the liner part 34 was initially generally cylindrical, after the PT closure 20 has been applied the threads 50 mold complementary threads into the compound of the liner portion 34. Thus, the applied PT closure may be readily removed in a twisting off action.

The difficulty is not in the initial application of the PT closure or the sealing thereof to the container. The difficulty, as set forth above, is resealing the container with the closure. It must be appreciated that the compound of the liner 30 is quite soft and moldable, and therefore, unless the closure is properly positioned relative to the neck finish, the threads 50 will not all reenter the threads formed in the liner. It has been found, however, that by tapering the uppermost section of the neck finish and offsetting the same radially inwardly to form the surface 42, a generally straightening effect is had on the closure. This taper, which is identified by the angle A, may be on the order of 4° ±1°. In addition, the tapered width of the threads 50 each present at the lower edge of the cylindrical liner part 34 a wide thread groove into which the tapered end 52 of a thread may readily enter.

The above-discussed combination of features of the neck finish 38 permits resealing of a container provided with this neck finish wherein the closure is a PT cap.

Figures 6, 7, 8, 9, 10, 11, 12, 13:
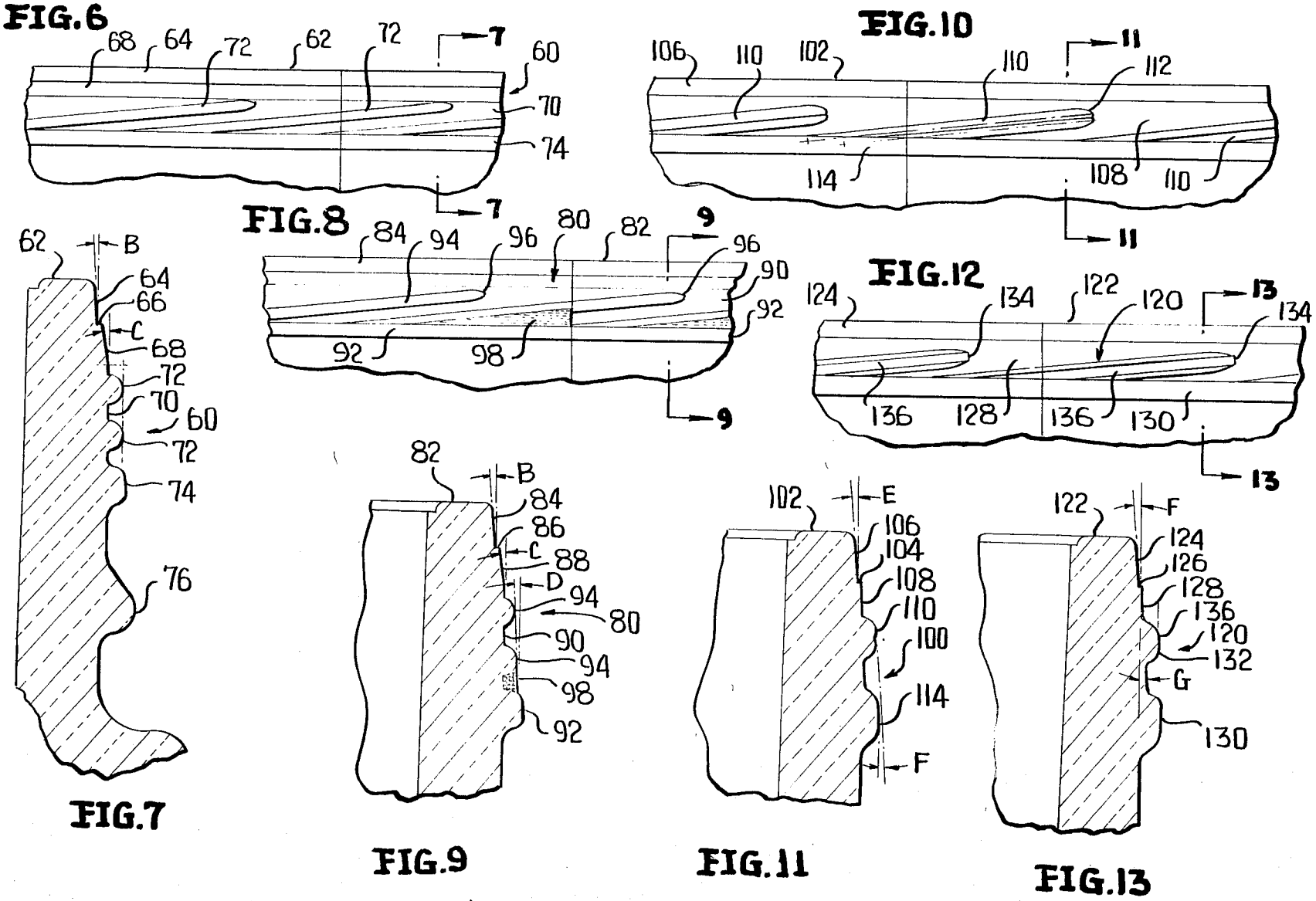
FIG. 6 is a fragmentary developed view of another form of neck finish.
FIG. 7 is an enlarged fragmentary sectional view through the neck finish of FIG. 6, taken along the line 7—7 of FIG. 6.
FIG. 8 is a fragmentary developed view of another form of neck finish.
FIG. 9 is an enlarged fragmentary vertical sectional view taken through the neck finish of FIG. 8 along the line 9—9.
FIG. 10 is a developed view of yet another neck finish.
FIG. 11 is an enlarged fragmentary sectional view taken through the neck finish of FIG. 10 along the line 11—11.
FIG. 12 is a developed view of a further form of neck finish.
FIG. 13 is an enlarged fragmentary sectional view of the neck finish of FIG. 12, taken generally along the line 13—13.

Reference is now made to the neck finish of FIGS. 6 and 7 which is generally identified by the numeral 60. The neck finish 60 defines an end 62 and the outer surface of the neck finish immediately adjacent the end is tapered to define a generally conical surface 64 which is offset radially inwardly to define a step 66. The taper of the surface 64 is at an angle B which may be on the order of 2°, +1°, −2°. Below the step 66 is another tapered exterior surface 68 of the neck finish which is tapered at an angle C which is on the order of 7°±2°.

The surface 68 terminates in a cylindrical thread base 70 from which there projects a plurality of circumferentially spaced threads 72 which may be of a conventional cross section which terminate in a rib 74. Once again, there may be a bead 76 spaced axially below the rib 74.

It will be seen that the tapered surfaces 64, 68 together with the radially inward stepping of the surface 64 provides starter surfaces for aligning the cap squarely with the neck finish and thereby facilitate the starting of the threads into the thread grooves formed in the cylindrical liner portion 34.

In FIGS. 8 and 9 there is illustrated yet another neck finish generally identified by the numeral 80. The neck finish 80 defines an end 82 with which a seal is made by the liner of the PT cap. The outer surface of the neck finish is provided adjacent the end 82 with a tapered surface 84 which is stepped radially inwardly to define a step 86. Below the step 86 is a further tapered surface 88. The tapered surface 88 terminates in a cylindrical thread base 90. It is to be understood that the surfaces 84, 88 correspond to the surfaces 64, 68 of the neck finish 60. The thread base 90 terminates in a rib 92 and above the rib 92 the thread base 90 has projecting therefrom a plurality of threads 94 each having a tapered lead-in 96. The threads 94 terminate in the rib 92 and and the space between base portions of the threads 94 and the rib 92 may be filled in as at 98.

It is to be particularly noted that the radially outer surfaces of the threads lie along a conical path which tapers radially inwardly and outwardly upwardly at an angle D which may be on the order of $2\frac{1}{2}° + 1, -2°$. The neck finish 90 is similar to the neck finish 60 except for the taper of the threads. The taper of the threads results in the thread grooves being of a larger diameter and they greatly increase in depth at the inner edge of the liner part 34 which, together with the centering action of the surfaces 84, 88, facilitates the re-engagement of the PT cap on the neck finish.

In FIGS. 10 and 11 there is illustrated yet another neck finish generally identified by the numeral 100. The neck finish 100 presents an end 102 for forming a seal with the liner part 32 of the PT closure. The upper outer surface of the neck finish 100 adjacent the end 102 is radially inwardly stepped to define a step 104 and is tapered to define a tapered surface 106 which tapers at an angle E which is on the order of 4°±1°. Below the step 104 is the thread base 108 which tapers axially downwardly and radially outwardly at an angle F on the order of 3°±1°.

Threads 110 project from the thread base 108 and have lead-ins 112. The threads 110 terminate in an annular rib 114. It is to be noted from FIG. 11 that the threads 110 are of a generally flattened ractangular cross section. Further, it will be apparent from FIG. 10 that each of the lead-ins 112 may be generally bifurcated.

In view of the fact that the thread base 108 tapers, the threads 110 also taper at a like angle.

The tapered surfaces together with the tapered threads combine to provide an easy restarting of the threads into the thread grooves molded into the liner of the PT closure.

In FIGS. 12 and 13 there is illustrated a further neck finish generally identified by the numeral 120. The neck finish 120 is similar to the neck finish 100 and includes a sealing end 122. The axially outer part of the exterior of the neck finish 120 is in the form of a tapered surface 124 which is stepped radially inwardly to define a step 126. The taper of the surface 124 is at an angle F on the order of 4°±1°.

Below the step 126 the thread base 128 tapers downwardly and radially outwardly at an angle G on the order of 4°±1°. Plural threads 132 project radially outwardly from the thread base 128 and have individual lead-ins 134 as is best shown in FIG. 12. The threads 134 are generally flattened and have flat radially outer uniform diameter surfaces 136 as is best shown in FIG. 13.

The neck finish 120 functions substantially the same as that of the neck finish 100 for re-engaging the threads 136 thereof into the thread grooves formed in the PT closure liner.

Once again, it is emphasized here that each and every one of the neck finishes specifically described herein-above is specifically configurated for use with PT closures of the type wherein there is a liner formed of a suitable compound such as plastisol and wherein the closure is pressed onto the neck finish and the threads of the neck finish mold threads into the cylindrical liner portion. The neck finishes specifically disclosed and claimed herein are not intended for use with closures of the type which are initially provided with threads and are twisted onto the container or closures which are placed on the containers and then have the threads rolled in the skirts thereof.

Although only several preferred embodiments of the invention have been specifically illustrated and described herein, it is to be understood that minor variations may be made in the neck finishes without departing from the spirit and scope of the invention as defined by the appended claims.

We claim:

1. A glass container of the jar and bottle type, said glass container comprising a neck finish having a surface configuration means particularly configurated for use with a closure of the push-on-twist-off type having a skirt with a generally cylindrical liner of deformable plastic material, said neck finish having plural lead threads which form complementary threads in said liner when said closure is applied, said neck finish being improved by resealing means for facilitating the re-engagement of said neck finish threads with said complementary threads in said liner, said sealing means including said threads increasing in width from lead ends thereof to terminal ends thereof in a smooth transition free of steps whereby a complementary thread which will be molded in a deformable plastic skirt liner will have a wide entrance portion for receiving a relatively narrow end of a neck finish thread.

2. A glass container neck finish according to claim 1 wherein said resealing means includes radially outer surfaces of said neck finish threads flaring axially downwardly and radially outwardly.

3. A glass container neck finish according to claim 1 wherein said resealing means includes both said thread base diameter and radially outer surfaces of said neck finish threads flaring axially downwardly and radially outwardly.

4. A glass container neck finish in accordance with claim 3 wherein said threads are of a flattened generally rectangular cross section.

5. A glass container neck finish in accordance with claim 1 wherein said threads are of a flattened generally rectangular cross section and have a flat central peripheral surface.

6. The combination of a glass container of the jar and bottly type and a closure, said closure being of the push-on-twist-off type having a skirt with a generally cylindrical liner of deformable plastic material, surface configuration means particularly configurated for use with said closure of the push-on-twist-off type having a skirt with a generally cylindrical liner of deformable plastic material, said neck finish having plural lead threads which form complementary threads in said liner, said neck finish being improved by resealing means for facilitating the re-engagement of said neck finish threads with said complementary threads in said liner, said sealing means including said threads increasing in width from lead ends thereof to terminal ends thereof in a smooth transistion free of steps whereby a complementary thread molded in said skirt liner has a wide entrance portion for receiving a relatively narrow end of a neck finish thread.

7. A glass container and closure combination according to claim 6 wherein said resealing means includes radially outer surfaces of said neck finish threads flaring axially downwardly and radially outwardly.

8. A glass container and closure combination according to claim 6 wherein said resealing means includes both said thread base diameter and radially outer surfaces of said neck finish threads flaring axially downwardly and radially outwardly.

9. A glass container and closure combination in accordance with claim 6 wherein said threads are of a flattened generally rectangular cross section.

10. A glass container and closure combination according to claim 6 wherein said resealing means includes said threads being of a flattened generally rectangular cross section.

11. A glass container and closure combination in accordance with claim 6 wherein said threads are of a flattened generally rectangular cross section and have a flat central peripheral surface.

* * * * *